US006797118B1

(12) United States Patent
Koivukunnas et al.

(10) Patent No.: US 6,797,118 B1
(45) Date of Patent: Sep. 28, 2004

(54) METHOD AND ARRANGEMENT FOR SURFACE TREATMENT OF A PAPER AND/OR BOARD WEB

(75) Inventors: Pekka Koivukunnas, Järvenpää (FI); Matti Lares, Helsinki (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/069,203

(22) PCT Filed: Aug. 14, 2000

(86) PCT No.: PCT/FI00/00690

§ 371 (c)(1),
(2), (4) Date: Jul. 10, 2002

(87) PCT Pub. No.: WO01/14637

PCT Pub. Date: Mar. 1, 2001

(30) Foreign Application Priority Data

Aug. 24, 1999 (FI) ..... 19991802

(51) Int. Cl.[7] ..... D21F 5/00; D21G 1/00

(52) U.S. Cl. ..... 162/206; 162/358.5; 162/361

(58) Field of Search ..... 162/206, 361, 162/358.5, 111, 113, 281; 100/153, 162 R

(56) References Cited

U.S. PATENT DOCUMENTS

| | | | |
|---|---|---|---|
| 4,016,030 | A | 4/1977 | Sobota |
| 5,163,364 | A | 11/1992 | Bubik et al. |

FOREIGN PATENT DOCUMENTS

| | | | |
|---|---|---|---|
| DE | 3815446 | A1 | 11/1989 |
| EP | 0719891 | A2 | 7/1996 |
| JP | 5-331793 | | 12/1993 |

*Primary Examiner*—Peter Chin
(74) *Attorney, Agent, or Firm*—Stiennon & Stiennon

(57) ABSTRACT

A method and an arrangement for surface treatment of a paper and/or board web (W) formed of a yankee cylinder (2) and a calendering unit (5) placed one after the other in the machine direction, by means of which the web (W) is first glazed and dried and after that immediately calendered.

10 Claims, 1 Drawing Sheet

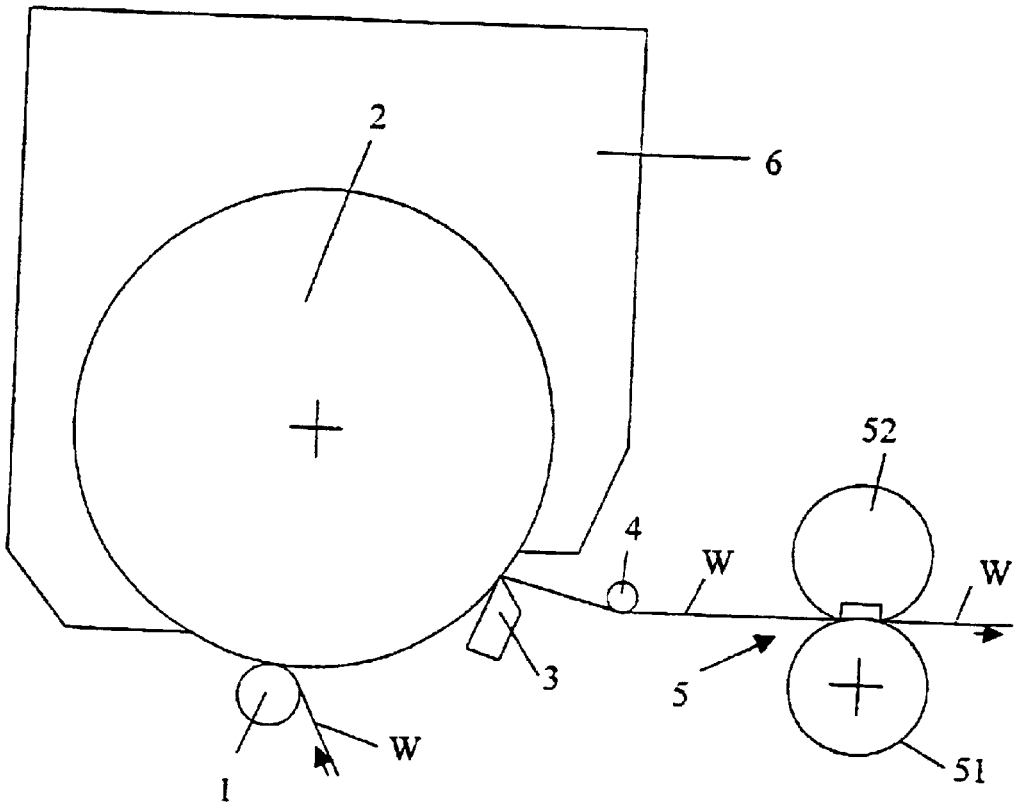
2
6
52
4
W
W
3
5
W
1
51

METHOD AND ARRANGEMENT FOR SURFACE TREATMENT OF A PAPER AND/OR BOARD WEB

CROSS REFERENCES TO RELATED APPLICATIONS

This application is a U.S. national stage application of International Application No. PCT/FI00/00690, filed Aug. 14, 2000, and claims priority on Finnish Application No. 19991802 filed Aug. 24, 1999, the disclosures of both of which applications are incorporated by reference herein.

STATEMENT AS TO RIGHTS TO INVENTIONS MADE UNDER FEDERALLY SPONSORED RESEARCH AND DEVELOPMENT

Not applicable.

The present invention relates to a method and arrangement for surface treatment of a paper and/or board web in a paper or board machine including a yankee cylinder followed by a calendering unit.

This kind of a machine is known from JP-A-05 331793. In the machine according to this JP-publication, the web's dried side is dried in the Yankee cylinder and the calendering unit being formed by soft calender. A soft calender has a short nip time, therefore final results, f.ex. web glazing, are difficult to manipulate.

Calendering is a method by means of which the properties, in particular smoothness and gloss, of a web-like material, such as a paper web, are improved after a drying unit in a paper or board machine. In calendering the paper web is passed into a nip which is formed between rolls pressed against each other and in which the paper web is deformed by the action of temperature, moisture and nip pressure, in which connection the physical properties of the paper web can be affected by controlling the above-mentioned parameters and the time of action.

Extended-nip calendering has been found to be a good means of producing low-gloss paper grades by calendering. When higher gloss is required, the nip pressure of extended-nip calendering does not necessarily suffice to provide gloss.

With ever-increasing running speeds, calendering is becoming a bottleneck in the papermaking process, and satisfactory quality is not achieved by today's machine calender units. Some of the drawbacks of the present papermaking process are also that the loss of bulk increases when gloss and smoothness are improved, and that in order to provide gloss and smoothness of sufficient quality, it is necessary to use webs with an abundance of coating and/or to use off-line calendering, in particular multi-nip supercalendering and/or soft calendering.

Machine calendering means here and hereafter calendering in a calender unit in which nips are formed between metal rolls. The width of the nip in a machine calender is typically very small depending on the width of the rolls and the thickness of the paper web to be calendered, wherefore the nip load is relatively high.

Supercalendering, which provides in off-line operation in practice the best result qualitywise, means above and hereafter calendering in a calender unit in which nips are formed between a metal or chilled thermoroll and a paper or polymer roll provided with a resilient surface, in which connection a nip of a substantial width is formed.

Soft calendering means above and hereafter calendering in a calender unit in which nips are formed in a manner similar to that of a supercalender between a metal or chilled roll and a roll having a resilient surface, in which connection a nip of a substantial width is formed. In soft calenders, each nip is formed between separate roll pairs, so that the nip load can be adjusted in each individual nip.

Shoe and/or extended-nip calendering means above and hereafter calendering in a calender unit in which a nip is formed between a roll provided with a flexible mantle, the mantle of said roll being made, for example, of polyurethane, and a press roll or shoe roll which has a rigid mantle and is provided with an inside loading shoe and which is made of metal, such as steel. One extended-nip concept marketed by the applicant is called OptiDwell™, which includes two different extended-nip calenders:

OptiDwell Shoes™ calender based on shoe press technology,

OptiDwell Belts™ calender based on roll/belt technology.

A yankee cylinder represents a drying and glazing method known in the art for a long time, and the aim of the yankee cylinder is primarily to improve gloss but not to evaporate water. Yankee cylinders are employed mainly on paper and board machines which manufacture high-quality folding boxboards and envelope paper. On the yankee cylinder, the moisture of the web is about 65% at the most when it sticks to the surface of the cylinder and about 7–10% at the most when it is separated from the surface of the cylinder. The main problem with the yankee cylinder is, thus, its speed dependence. The evaporation capacity of the yankee cylinder is limited, so when the speed is increased, the surface of the web is no longer glazed to a satisfactory degree.

The primary object of the present invention is to provide an improvement in this detrimental speed dependence which is characteristic of the yankee cylinder and, with the improvement, to make it possible to increase speed without the quality, i.e. gloss and smoothness of paper or board suffering.

This objective is achieved according to the invention by means of a method and an arrangement of the mentioned at the beginning, the principal special features of the method being set forth in the characterizing part of the accompanying independent claim 1, and the principal special features of the arrangement being set forth in the characterising part of the accompanying independent claim 4.

Thus, the invention is based on the new and inventive basic idea that, after the web has been dried and glazed on a yankee cylinder, the web is glaze calendered by using a shoe and/or extended-nip calendering unit as a calender placed after the yankee cylinder in accordance with an embodiment of the invention which is regarded as advantageous.

In accordance with an embodiment of the invention considered to be particularly advantageous, the method employs and the arrangement comprises a combination in which there are disposed in the machine direction first a yankee cylinder and then a shoe calendering unit which serves as a glazing calender.

With respect to the other characteristic features peculiar to the invention and the advantages attainable by them reference is made to the dependent claims of the accompanying set of claims.

The invention and the advantages which can be attained by it are described below by way of example by means of an embodiment of the invention regarded as advantageous with reference to the accompanying drawing, the figure of which schematically shows an arrangement according to an advantageous embodiment of the invention for surface treatment of paper and/or board.

The arrangement according to the embodiment shown in the figure for surface treatment of a paper and/or board web W comprises a yankee cylinder 2 and a calendering unit 5 placed after it in the direction of processing of the web W, said calendering unit being in the embodiment shown in the figure a single nip glazing-calendering unit whose extended nip is formed between a metal or chilled thermoroll 51 provided with a rigid mantle and a shoe roll 52 provided with a flexible mantle. The shoe roll 52 comprises an inside glide shoe which, when supported on the inside frame structure of the shoe roll 52, presses the flexible mantle of the shoe roll 52 or a roll/belt structure placed around the shoe roll (not shown in the figure) against the thermoroll 51 having a rigid mantle. When it is intended to achieve a given paper or board quality, the difference between the running speed used in the machine and the running speed allowed by the evaporation capacity of the yankee cylinder can be compensated for by means of the glazing calender unit 5, i.e. the use of the glazing calender unit 5 enables the speed of the machine to be increased without the quality, that is, gloss and smoothness of paper or board suffering.

The web W to be treated is passed as a supported or free draw into a nip defined between the yankee cylinder 2 having a smooth surface and a wire or press roll 1 having a rubber surface, as shown in the figure, or into nips defined between the yankee cylinder 2 and two wire or press rolls placed one after the other in the machine direction. Said nip/nips has/have no primary dewatering function but their primary function is glazing, and in addition thereto, the web W sticks to the surface of the yankee cylinder 2 by means of the wire or press roll 1. After the nip between the yankee cylinder 2 and the wire or press roll 1, the web W runs onwards on the surface of the yankee cylinder 2, on which a steam pressure of about 350 kPa acts on the outer surface of the web inside a hood 6, said pressure producing an evaporation capacity of 30–50 kg/m$^{2-}$, which dries the web from an incoming moisture which is typically 65–50% but preferably not more than 70–80% to a final moisture which is typically 7–10%.

The web W is separated from the surface of the yankee cylinder 2 by means of a doctor device 3 and a take-out roll 4. After the doctor device 3 and the rout roll 4, the web W is guided into the extended nip between the rigid-mantle roll 51 and the flexible-mantle roll 52 of the shoe or extended-nip calendering unit 5. The shoe calendering unit 5, disposed after the yankee cylinder 2 in accordance with the invention, functions in the arrangement of the invention as a glazing calender which allows, without the desired quality of paper or board suffering because of the limited evaporation capacity of die yankee cylinder 2, the running speed used in the machine to be raised to a higher level than said maximum running speed dependent on the evaporation capacity of the yankee cylinder 2. Advantageously, the "gloss surface" of the web glazed on the yankee cylinder 2 is glazed in this calendering unit 5.

The web W can be wound after the glazing carried out by means of the shoe calender 5.

Based on the trial run results of the arrangement according to the invention, it has been possible to establish generally that the quality values of the web are improved, i.e. the bending resistance of the web in relation to the thickness of the web remains unchanged, its PPS roughness decreases and Hunter gloss improves when the yankee cylinder is followed by shoe calendering, and further that the improvement of the quality values is the clearer, the higher the linear load in the nip of the shoe calender. Some quality values as a function of the shoe calender are further shown below in table form.

TABLE

| | attained quality values | | |
|---|---|---|---|
| PROPERTY | yankee glazed | yankee glazed and shoe calender treatment 200 kN/m | yankee glazed and shoe calender treatment 400 kN/m |
| Thickness, 1m | 125 | 121 | 117 |
| Bending resistance ks, mN | 150 | 143 | 126 |
| PPS roughness, 1m | 4.2 | 3.4 | 2.9 |
| Hunter gloss, % | 26 | 30 | 33 |

Above, the invention has been described only by way of example by means of some of its embodiments regarded as advantageous. This is of course not intended to limit the invention and, as is clear to a person skilled in the art, many alternative arrangements and modifications are feasible within the inventive idea and its scope of protection defined in the accompanying claims.

What is claimed is:

1. A method for surface treatment of a paper and/or board web in a paper or board machine including a yankee cylinder having a smooth surface followed by a calendering unit, comprising the steps of:

pressing a paper or board web with a moisture of 50% to 80% with a press roll on to the smooth surface of the yankee cylinder;

drying and glazing the web on the smooth surface of the yankee cylinder, the paper or board web forming a gloss surface in contact with the smooth surface of the yankee cylinder;

separating the paper or board web from the yankee cylinder with a doctor device;

following separating with the doctor devices guiding the paper or board web immediately into a shoe calender unit having a shoe press within a flexible mantle, and forming a nip with a roll having a rigid mantle made of metal, wherein the gloss surface of the paper or board web is further glazed in contact with the rigid mantle made of metal.

2. The method of claim 1, further comprising the step of increasing the running speed of the yankee cylinder and compensating for the loss of gloss and smoothness of the paper or board resulting from the increased running speed by the calendering after the yankee cylinder.

3. The method of claim 1 wherein the nip pressure is at least 200 kN/m and the Hunter gloss of the gloss surface is at least 30% after the shoe calender unit.

4. An arrangement for surface treatment of paper and/or board in a paper or board machine including a yankee cylinder followed by a calendering unit comprising:

a paper or board web with a moisture of 50% to 80% wrapped on to a yankee cylinder having a smooth drying surface, so that a first surface of the paper or board web is engaged with the smooth drying surface of the yankee cylinder;

following the yankee cylinder the paper or board web extends to a doctor device and then further extends to a calendering unit, which is formed by a shoe calender unit having a shoe press within a flexible mantle, and forming a nip with a roll having a rigid mantle made of metal, wherein the first surface of the paper or board web is further in glazing contact with the rigid mantle made of metal.

5. A method for surface treatment of a paper and/or board web in a paper or board machine comprising the steps of:

pressing a paper or board web with a moisture of 50% to 80% with a press roll on to the smooth surface of a yankee cylinder;

drying and glazing the web on the smooth surface of the yankee cylinder, the paper or board web forming a gloss surface in contact with the smooth surface of the yankee cylinder;

running the yankee cylinder at a first running speed which is the maximum speed to obtain a given quality of web gloss and smoothness;

increasing the running speed of the yankee cylinder beyond the first running speed to produce a web having a quality of web gloss and smoothness which is below the given quality;

separating the paper or board web from the yankee cylinder with a doctor device;

following separating with the doctor device, guiding the paper or board web immediately into a shoe calender unit having a shoe press within a flexible mantle, and forming a nip with a roll having a rigid mantle made of metal, wherein the gloss surface of the paper or board web is further glazed in contact with the rigid mantle made of metal to impart the given quality of web gloss and smoothness to the web.

6. The method of claim 5 wherein the nip pressure is at least 200 kN/m and the Hunter gloss of the gloss surface is at least 30% after the shoe calender unit.

7. A method for surface treatment of a paper and/or board web in a paper or board machine including a yankee cylinder having a smooth surface followed by a calendering unit, comprising the steps of:

pressing a paper or board web with a moisture of 50% to 80% with a press roll on to the smooth surface of the yankee cylinder;

drying and glazing the web on the smooth surface of the yankee cylinder, the paper or board web forming a gloss surface in contact with the smooth surface of the yankee cylinder;

separating the paper or board web from the yankee cylinder with a doctor device; and following separating with the doctor device guiding the paper or board web immediately into a belt calender unit having a roll within a flexible mantle and forming a nip with a roll having a rigid mantle made of metal, wherein the gloss surface of the paper or board web is further glazed in contact with the rigid mantle made of metal.

8. The method of claim 7 further comprising the steps of increasing the running speed of the yankee cylinder and compensating for the loss of gloss and smoothness of the paper or board resulting from the increased running speed by the is calendering after the yankee cylinder.

9. An arrangement for surface treatment of paper and/or board in a paper or board machine including a yankee cylinder followed by a calendering unit comprising:

a paper or board web with a moisture of 50% to 80% wrapped on to a yankee cylinder having a smooth drying surface, so that a first surface of the paper or board web is engaged with the smooth drying surface of the yankee cylinder;

following the yankee cylinder the paper or board web extends to a doctor device and following the doctor device the paper or board web extends through a belt calender unit, the belt calender unit having a roll within a flexible mantle and forming a nip with a roll having a rigid mantle made of metal, wherein the first surface of the paper or board web is in contact with the rigid mantle made of metal.

10. A method for surface treatment of a paper and/or board web in a paper or board machine comprising the steps of:

pressing a paper or board web with a moisture of 50% to 80% with a press roll on to the smooth surface of a yankee cylinder;

drying and glazing the web on the smooth surface of the yankee cylinder, the paper or board web forming a gloss surface in contact with the smooth surface of the yankee cylinder;

running the yankee cylinder at a first running speed which is the maximum speed to obtain a given quality of web gloss and smoothness;

increasing the running speed of the yankee cylinder beyond the first running speed to produce a web having a quality of web gloss and smoothness which is below the given quality;

separating the paper or board web from the yankee cylinder with a doctor device; and following setting with the doctor device, guiding the paper or board web immediately into a belt calender unit having a roll within a flexible mantle and forming a nip with a roll having a rigid mantle made of metal, wherein the gloss surface of the paper or board web is further glazed in contact with the rigid mantle made of metal to impart the given quality of web gloss and smoothness to the web.

* * * * *

UNITED STATES PATENT AND TRADEMARK OFFICE

CERTIFICATE OF CORRECTION

PATENT NO. : 6,797,118 B1
APPLICATION NO. : 10/069203
DATED : September 28, 2004
INVENTOR(S) : Pekka Koivukunnas et al.

It is certified that error appears in the above-identified patent and that said Letters Patent is hereby corrected as shown below:

In column 1, line 26 of the issued patent, “f. ex.” should be --for example--

In column 2, line 44 of the issued patent, “glaze calendered” should be --glaze-calendered--

In column 2, line 2-5 of the issued patent, after “drawing” delete “, the figure of which schematically shows an arrangement according to an advantageous embodiment of the invention for surface treatment of paper and/or board”

In column 3, line 35 of the issued patent, “$m^{2-}$,” should be --$m^2$,--

In column 4, line 8 of the issued patent, “1m” should be --µm--

In column 4, line 12 of the issued patent, “1m” should be --µm--

In column 6, line 5 of the issued patent, before “calendering” delete “is”

In column 6, line 42 of the issued patent, “setting” should be --separating--

Signed and Sealed this

Fifth Day of June, 2007

JON W. DUDAS
*Director of the United States Patent and Trademark Office*